US010274251B2

(12) United States Patent
High et al.

(10) Patent No.: US 10,274,251 B2
(45) Date of Patent: Apr. 30, 2019

(54) SYSTEMS AND METHODS FOR COOLING PRODUCTS DURING TRANSPORTATION

(71) Applicant: Walmart Apollo, LLC, Bentonville, AR (US)

(72) Inventors: Donald R. High, Noel, MO (US); Tariq B. Islam, Rogers, AR (US); Chandrashekar Natarajan, Valencia, CA (US)

(73) Assignee: Walmart Apollo, LLC, Bentonville, AR (US)

( * ) Notice: Subject to any disclaimer, the term of this patent is extended or adjusted under 35 U.S.C. 154(b) by 52 days.

(21) Appl. No.: 15/459,405

(22) Filed: Mar. 15, 2017

(65) Prior Publication Data

US 2017/0299248 A1 Oct. 19, 2017

Related U.S. Application Data

(60) Provisional application No. 62/309,320, filed on Mar. 16, 2016.

(51) Int. Cl.

| | |
|---|---|
| ***B65B 63/08*** | (2006.01) |
| ***F25D 29/00*** | (2006.01) |
| ***F25D 3/10*** | (2006.01) |

(52) U.S. Cl.

CPC ..... *F25D 29/003* (2013.01); *F25D 3/107* (2013.01); *F25D 29/001* (2013.01)

(58) Field of Classification Search

CPC ..... F25D 29/003; F25D 29/001; F25D 29/00; F25D 3/107; F25D 3/105; F25D 2700/06;

(Continued)

(56) References Cited

U.S. PATENT DOCUMENTS 2,007,154 A * 7/1935 Bowes ..... B65D 25/04 220/23.88
4,621,500 A * 11/1986 Pagani ..... F25D 3/105 62/239

(Continued)

FOREIGN PATENT DOCUMENTS

| | | |
|---|---|---|
| CN | 202717313 | 2/2013 |
| EP | 2614729 | 7/2013 |

(Continued)

*Primary Examiner* — Joseph Trpisovsky
(74) *Attorney, Agent, or Firm* — Fitch, Even, Tabin & Flannery LLP

(57) ABSTRACT

In some embodiments, a package for cooling a product includes an exterior package wall, an interior package wall coupled to the exterior package wall and defining an interior cavity for retaining the product and an opening for receiving the product into the interior cavity, a coolant supply unit configured to be activated to introduce coolant into a space between the interior package wall and the exterior package wall, and an electronic monitoring device including a temperature sensor and a control unit configured to activate the coolant supply unit to introduce the coolant into the space between the interior package wall and the exterior package wall in response to a detection by the electronic monitoring device that a temperature in the interior cavity is above a predetermined threshold. Systems and methods of cooling a product are also described.

18 Claims, 4 Drawing Sheets

(58) Field of Classification Search
CPC ..... F25D 2700/12; F25D 2700/00; F25D 2400/32; F25D 5/00; F25D 5/02; B65D 81/18; B65D 83/14; B65D 83/28
USPC ..... 62/60, 214
See application file for complete search history.

(56) References Cited

U.S. PATENT DOCUMENTS

| | | | | |
|---|---|---|---|---|
| 5,630,321 | A | 5/1997 | Miller | |
| 6,089,146 | A * | 7/2000 | Nam | A23B 7/10 435/286.1 |
| 6,226,996 | B1 | 5/2001 | Weber | |
| 6,995,980 | B2 | 2/2006 | Tustaniwskyj | |
| 7,561,424 | B2 | 7/2009 | Bjork | |
| 2002/0053213 | A1 * | 5/2002 | Lajeunesse | A61J 1/165 62/159 |
| 2014/0088768 | A1 | 3/2014 | Haley | |
| 2014/0157797 | A1 * | 6/2014 | Kovalick | F25D 3/06 62/60 |

FOREIGN PATENT DOCUMENTS

| | | | |
|---|---|---|---|
| WO | WO9015293 | * | 12/1990 |
| WO | 2014187483 | | 11/2014 |

* cited by examiner

SYSTEMS AND METHODS FOR COOLING PRODUCTS DURING TRANSPORTATION

RELATED APPLICATIONS

This application claims the benefit of U.S. Provisional Application No. 62/309,320, filed Mar. 16, 2016, which is incorporated herein by reference in its entirety.

TECHNICAL FIELD

This invention relates generally to cooling of consumer products and, in particular, to systems and methods of cooling consumer products during transportation.

BACKGROUND

Some products ordered by consumers require refrigeration or freezing to maintain the freshness or texture of the products. While such products are typically kept in large refrigerators, chillers, or freezers during storage at an order fulfillment facility (e.g., warehouse, distribution center, retail store, or the like), delivering such products while maintaining the desired temperature of the products presents a challenge. Generally, preserving frozen products frozen and cold products cold during transportation between facility and during delivery to consumers is a challenge which is usually solved by delivery trucks having refrigerator, chiller, or freezer compartments.

Equipping delivery trucks with refrigerator, chiller, and/or freezer units is expensive and requires the use of professional drivers, adding to the transportation cost for retailers. In addition, providing electrical power and mechanical maintenance to such units is expensive. Since many delivery trucks transport products other than refrigerated and frozen products, the refrigerator/freezer units on delivery trucks are often underutilized. As such, a need exists to provide a more efficient means for transporting refrigerated and frozen products without having to freeze an entire cargo area or an entire section of a cargo area of a truck.

BRIEF DESCRIPTION OF THE DRAWINGS

Disclosed herein are embodiments pertaining to devices, systems, and methods for cooling products during transportation. This description includes drawings, wherein.

Elements in the figures are illustrated for simplicity and clarity and have not been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, systems and methods are provided for adding a product discarded by a consumer to a shopping list of the consumer based on consumer-specified product reorder settings.

In some embodiments, a package for cooling a product includes an exterior package wall; an interior package wall coupled to the exterior package wall and defining an interior cavity for retaining the product and an opening for receiving the product into the interior cavity; a coolant supply unit configured to be activated to introduce coolant into a space between the interior package wall and the exterior package wall; and an electronic monitoring device including a temperature sensor and a control unit configured to activate the coolant supply unit to introduce the coolant into the space between the interior package wall and the exterior package wall in response to a detection by the electronic monitoring device that a temperature in the interior cavity is above a predetermined threshold.

In other embodiments, a method of cooling a product includes: providing a package configured to retain the product and including a coolant supply unit and an electronic monitoring device including a temperature sensor and a control unit configured to activate the coolant supply unit; setting, on the electronic monitoring device, a predetermined threshold temperature for the interior of the package; detecting, via the electronic monitoring device, a temperature in the package; and activating, via the electronic monitoring device, the coolant supply unit to introduce coolant into the package in response to detecting by the electronic monitoring device that the temperature in the package is above the predetermined threshold.

Figure 1:
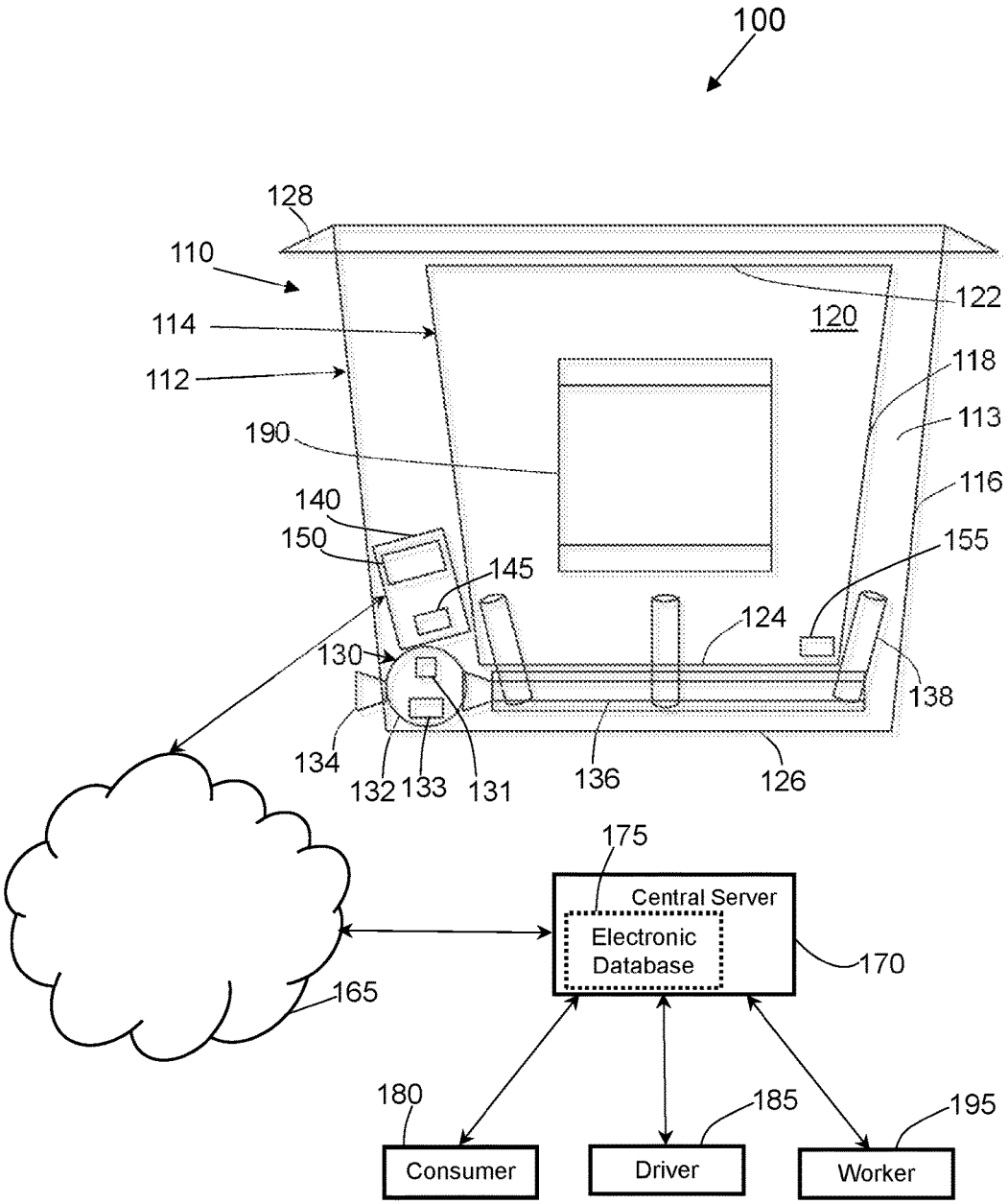
FIG. 1 is a diagram of a system for cooling a product for transportation to a consumer in accordance with some embodiments.

Referring to FIG. 1, one embodiment of a system 100 for cooling a product 190 is shown. The exemplary system 100 depicted in FIG. 1 includes a package 110 for cooling a product 190. While FIG. 1 depicts the package 110 as containing one product 190, it will be appreciated that the package 110 may be sized and shaped to retain two or more products 190. In the embodiment illustrated in FIG. 1, the package 110 includes an exterior lining or exterior package 112 and an interior lining or interior package 114 coupled to the exterior package 112. The exterior package 112 includes an exterior package wall 116 and the interior package includes an interior package wall 118. The interior package wall 118 defines an interior cavity 120, an opening 122 sized and shaped for receiving one or more products 190 into the interior cavity 120, and a closed bottom end 124 opposite the opening 122. The exterior package wall 112 has a closed bottom end 126.

The package 110 may be in the form of a container, tote, flexible bag, shrink wrap, or the like. One or both of the exterior package 112 and the interior package 114 may be manufactured from plastic, paper, or metal. In some embodiments, the material from which the exterior package wall 112 and the interior package wall 114 are made is a flexible material including one or more plastic polymers, co-polymers, unmetalized or metalized laminates, paper, or the like. A portion of the exterior package wall 116 or the entire exterior package wall 116 may include insulating material in some embodiments.

The package 110 illustrated in FIG. 1 further includes a closure 128 configured to seal the opening 122. The closure 128 may be a separate lid that is detachably or non-detachably coupled to one or both of the exterior package wall 116 and the interior package wall 118 to permit for multiple openings, reclosures, and reopenings of the package 110 (e.g., during insertion and/or removal of a product 190). In some embodiments, the closure 128 may be a mechanical or adhesive-based closure coupled to, applied onto, or integrally incorporated into the physical structure of the exterior side wall 112. Examples of suitable closures 128 include but are not limited to adhesive strips, slider zippers, clips, tabs, interlocking strips, or the like.

The exemplary package 110 shown in FIG. 1 includes a coolant supply unit 130. The exemplary coolant supply unit 130 illustrated in FIG. 1 includes a coolant container 132, a coolant intake 134, a coolant introduction conduit 136, and a plurality of coolant disbursement nozzles 138. The coolant supply unit 130 is configured such that the coolant container 132 may be activated to release a coolant (which may be stored in the coolant container 132 as a liquid or an aerosol) into the coolant introduction conduit 136, which is in turn configured to deliver the coolant to the coolant disbursement nozzles 138, which are in turn configured to spray the coolant into a space 113 between the exterior package wall 116 and the interior package wall 118. In the embodiment of FIG. 1, the coolant supply unit 130 includes an activator switch 131 configured to activate the coolant supply unit 130 in response to an activation signal received from an electronic monitoring device 140, which will be described in more detail below.

As can be seen in FIG. 1, the coolant container 132, the coolant introduction conduit 136, and the coolant disbursement nozzles 138 of the coolant supply unit 130 are located in the space 113 between the interior package wall 118 and the exterior package wall 116, while a portion of the coolant intake 134 of the coolant supply unit 130 protrudes outwardly from the exterior package wall 116. It will be appreciated that a portion of one or more of the disbursement nozzles 138 may extend in the space 113 and into the interior cavity 120 of the interior package 114, and that one or both of the coolant container 132 and the coolant introduction conduit 136 may be coupled to an exterior of the exterior package wall 116.

The exemplary package 110 in FIG. 1 further includes an electronic monitoring device 140 including a temperature sensor 145 and a control unit 150. The temperature sensor 145 may be in the form of one or more conventional sensors configured to measure the temperature in the interior cavity 120 of the interior package 114 and/or in the space 113 between the interior package 114 and the exterior package 112. In some embodiments, the control unit 150 of the electronic monitoring device 140 is processor-based as described in more detail below. As discussed in more detail below, the electronic monitoring device is configured for two-way communication via a network 165 (which may be wired or wireless) with a central server 170 coupled to an electronic database 175.

In some embodiments, to maintain the product 190 in the interior cavity 120 of the package 110 at or below a temperature needed to preserve the desired freshness and/or texture of the product 190, the processor of the control unit 150 may be programmed with a predetermined temperature threshold that, if exceeded, triggers activation of coolant release from the coolant supply unit 130. For example, a threshold temperature for frozen products may be 26-32° F., while a threshold temperature for refrigerated products may be 36-40° F.

In some embodiments, in response to a detection by the temperature sensor 145 of the electronic monitoring device that a temperature in the interior cavity 120 of the package 110 is above a predetermined threshold temperature, the control unit 150 of the electronic monitoring device 140 is programmed to activate the coolant supply unit 130 (e.g., by sending a signal to the activator switch 131) to introduce the coolant into the space 113 between the interior package wall 118 and the exterior package wall 116, which is effective to lower the temperature in the interior cavity 120 and thereby lower the temperature of the product 190 in the interior cavity 120. By the same token, in response to a detection by the temperature sensor 145 of the electronic monitoring device that a temperature in the interior cavity 120 of the package 110 is below a predetermined threshold temperature, in some embodiments, the control unit 150 of the electronic monitoring device 140 is programmed to deactivate the coolant supply unit 130 when the temperature in the interior cavity 120 of the interior package wall 118 is detected by the temperature sensor 145 of the electronic monitoring device 140 to be at or below the predetermined threshold after introduction of the coolant by the coolant supply unit 130 into the space 113 between the interior package wall 118 and the exterior package wall 116. An advantage of spraying coolant into the space 113 and not into the interior cavity 120 is that the product 190 may be cooled to the desired threshold temperature without being directly sprayed with the coolant disbursed from the nozzles 138, which may be undesirable.

In some embodiments, the coolant supply unit 130 includes a coolant level sensor 133. The coolant level sensor 133 may be coupled to the coolant container 132 and configured to detect the level of coolant present in the coolant container 132. In some embodiments, the coolant level sensor 133 is configured to transmit a signal indicating the level of coolant in the coolant container 132 of the coolant supply unit 130 to the electronic monitoring device 140. In response to receiving the coolant level data from the coolant level sensor 133, the control unit 150 of the electronic monitoring device 140 may be programmed, in some embodiments, to activate the temperature sensor 145 only in response to receipt of coolant level sensor data from the coolant level sensor 133 indicating that the coolant container 132 of the coolant supply unit 130 is full of coolant. Conversely, if the coolant level sensor data received by the electronic monitoring device 140 from the coolant level sensor 133 indicates that the coolant level in the coolant container 132 is not full, the control unit 150 may be programmed to restrict activation of the temperature sensor 145 and/or to send an alert signal (e.g., to the central server 170 or a hand-held device of a worker) to indicate that the coolant level is not full. Activation of temperature monitoring in the package 110 only when the coolant level in the coolant container 132 is full may avoid situations where the package 110 is used to transport a product 190 that requires being maintained at or below a certain temperature, but the coolant container 132 of the package 110 does not have enough coolant to maintain this temperature during transportation.

In some embodiments, the package 110 includes a product detecting sensor 155 configured to detect the presence of one more products 190 in the interior cavity 120 of the package 110. The product detecting sensor 155 may be a motion-detecting sensor, a photo sensor, a radio frequency identification (RFID) sensor, an optical sensor, a barcode sensor, a digital camera sensor, a weight sensor, or the like. While the product detecting sensor 155 may be coupled to the interior package wall 118 of the package 110 such that the product detecting sensor 155 is closer to the bottom end 124 of the interior package 114 than to the opening 122 of the interior package 114 as shown in FIG. 1, it will be appreciated that the location of the product detecting sensor 155 in FIG. 1 is exemplary, and that the product detecting sensor 155 may be located anywhere in or near the interior package 114. In some embodiments, the product detecting sensor 155 may be coupled to an exterior surface of the interior package wall 118 such that the product detecting sensor 155 is located in the space 113 between the interior package 114 and the exterior package 112. In some embodiments, the product detecting sensor 155 may be coupled to an exterior surface of the exterior package wall 116. In other embodiments, the product detecting sensor 155 may be incorporated into the physical structure of the electronic monitoring device 140, such that no separate product detecting sensor 155 is present.

In some embodiments, the control unit 150 of the electronic monitoring device 140 is configured for communication (e.g., via electrical wired signals and/or wireless signals) with the product detecting sensor 155, the coolant level sensor 133, and/or the temperature sensor 145. As shown in FIG. 1, the electronic monitoring device 140 may be configured (e.g., by including a transmitter) to transmit temperature data representing one or more temperature values detected in the interior cavity 120 of the package 110 by the temperature sensor 145 of the electronic monitoring device 140 over a wireless network 165 to a central server 170 in communication with the electronic monitoring device 140 and configured to record the temperature data (e.g., in an electronic database 175).

In addition, as shown in FIG. 1, the electronic monitoring device 140 may be configured to transmit temperature data representing at least one temperature value detected in the interior cavity 120 of the package 110 by the temperature sensor 145 over the wireless network 165 to a driver 185 (e.g., an electronic device of the driver 185 such as a mobile phone, tablet, or the like). This enables the driver delivering the product 190 in the package 110 to the consumer 180 to confirm that the product 190 is being maintained at or below the temperature required to preserve the freshness and/or the texture of the product 190. Further, as shown in FIG. 1, the electronic monitoring device 140 may be configured to transmit temperature data representing at least one temperature value detected in the interior cavity 120 of the package 110 by the temperature sensor 145 over the wireless network 165 to a consumer 180 (e.g., an electronic device of the consumer 180 such as a mobile phone, tablet, or the like). This enables a consumer receiving the product 190 delivered by the driver 185 to confirm that the product 190 was maintained at or below the temperature required to preserve the freshness and/or the texture of the product 190.

In the exemplary system 100 shown in FIG. 1, the central server 170 is shown as a single computing device, but it will be appreciated that the central server 170 may be implemented as two or more computing devices at one location (e.g., a data center), or as multiple interconnected computing devices stored at two or more locations. The central server 170 is shown in FIG. 1 as being in two-way communication with the electronic monitoring device 140 via the network 165, which may be a wired network (e.g., DSL, cable, or the like) or a wireless network (e.g., Wi-Fi, Bluetooth, cellular, or the like). While FIG. 1 shows that the electronic monitoring device 140 is in two-way communication with the central server 170 via the network 165, it will be appreciated that the electronic monitoring device 140 and the central server 170 may be configured for one-way communication via the network 165. Likewise, the electronic monitoring device 140 may be configured for communicating directly with the central server 170 via the network 165 as shown in FIG. 1, or may be configured for communicating with the central server 170 indirectly via one or more intermediate communication devices.

In the embodiment shown in FIG. 1, the central server 170 is coupled to an electronic database 175. The electronic database 175 may be configured to store information associated with products 190 ordered by a consumer 180 and transported (e.g., to the consumer 180) in one or more packages 110. The electronic database 175 may also store information pertaining to the inventory of products 190 available to the consumer 180 for purchase and information pertaining to delivery status of a product 190, as well as information pertaining to storage temperatures of the product 190 during transportation.

While the central server 170 is illustrated in FIG. 1 as including one electronic database 175, it will be appreciated that the central server 170 may include or be connected to two or more separate electronic databases (e.g., one electronic database configured to store product inventory information, one electronic database to store product delivery status information, and one electronic database to store product storage temperature information.) The electronic database 175 may be stored, for example, on non-volatile storage media (e.g., a hard drive, flash drive, or removable optical disk) internal or external to the central server 170, or internal or external to computing devices separate and distinct from the central server 170.

Figure 2:
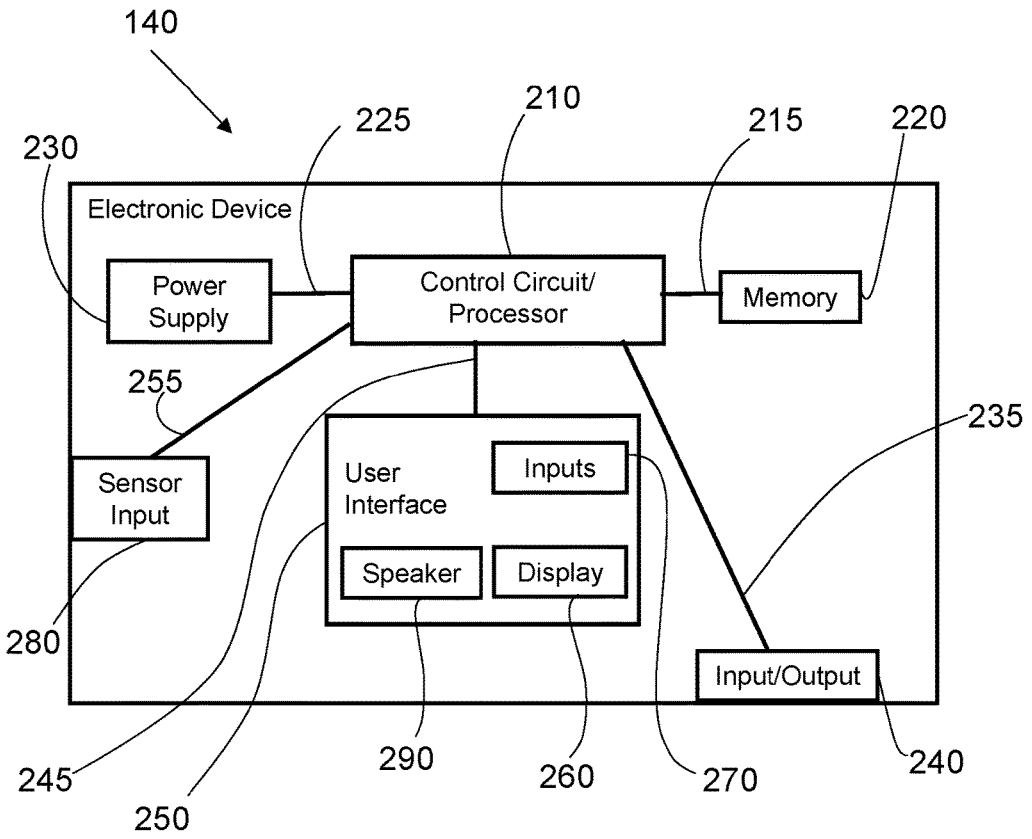
FIG. 2 is a functional diagram of an exemplary electronic monitoring device usable with the system of FIG. 1 in accordance with several embodiments.

With reference to FIG. 2, an exemplary electronic monitoring device 140 configured for use with the system 100 and methods described herein may include a control circuit 210 including a processor (for example, a microprocessor or a microcontroller) electrically coupled via a connection 215 to a memory 220 and via a connection 225 to a power supply 230. The control circuit 210 of the electronic monitoring device 140 is also electrically coupled via a connection 235 to an input/output 240 that can receive signals from the central server 170 (e.g., data from the electronic database 175) or from any other source that can communicate with the electronic monitoring device 140 (e.g., electronic device of a consumer 180 and/or driver 185) via a wired or wireless connection. The input/output 240 of the electronic monitoring device 140 can also send signals to the central server 170 (e.g., electronic data indicating current storage temperature of the product 190 in the package 110), or to any other electronic device (e.g., electronic device of a consumer 180 and/or driver 185) in communication with the electronic monitoring device 140 over the network 165.

In embodiments, where the product detecting sensor 155 and the electronic monitoring device 140 are implemented as two physically distinct units in communication with each other (as in FIG. 1), the electronic monitoring device 140 in FIG. 2 includes sensor inputs 280 configured to receive signals from the separate product detecting sensor 155. For example, the sensor input 280 of the electronic monitoring device 140 may be configured to receive electronic data from a motion-detecting sensor, a photo sensor, an RFID sensor, an optical sensor, a barcode sensor, a digital camera sensor, a weight sensor, or the like. As mentioned above, instead of receiving sensor data from a separate product detecting sensor 155, the electronic monitoring device 140 may optionally physically incorporate or be electrically coupled to the product detecting sensor 155. For example, the electronic monitoring device 140 may incorporate a product detecting sensor configured to detect and/or read information on an identifying indicia of the product 190 when the product 190 is in direct proximity to the electronic monitoring device 140 (such as when the product 190 is in the interior cavity 120 of the interior package 114). Such a reader may be an RFID reader, an optical reader, a barcode reader, a weight sensor, or the like.

In the embodiment shown in FIG. 2, the control circuit/processor 210 of the electronic monitoring device 140 is electrically coupled via a connection 245 to a user interface 250, which may include a visual display or display screen 260 (e.g., LED screen) and/or inputs 270 that provide the user interface 250 with the ability to permit a user (e.g., worker 195 at a product distribution and/or order fulfillment facility) to manually control the electronic monitoring device 140 by inputting commands via touch-screen and/or button operation and/or voice commands to, for example, activate or deactivate the temperature sensor 145 and/or to set a temperature threshold for a particular product 190 to be transported in the package 110.

In some embodiments, the display screen 260 of the electronic monitoring device 140 is also configured to permit the user to see various graphical interface-based menus, options, and/or alerts that may be displayed to the user by the electronic monitoring device 140 in connection with the user setting a predetermined threshold temperature for the product 190 in the package 110, or receiving an alert that the temperature is above or below the predetermined threshold temperature. The inputs 270 of the electronic monitoring device 140 may be configured to permit the user to navigate through the on-screen menus on the electronic monitoring device 140. It will be appreciated that the display screen 260 may, in some embodiments, be configured as both a display screen and an input 270 (e.g., a touch-screen that permits the user to press directly on the display screen 260 to enter text and/or execute commands.) The user interface 250 of the electronic monitoring device 140 may also include a speaker 290 that may provide audible feedback (e.g., beep-based alerts or voice-based instructions) to the user. In some embodiments, the input/output 240 of the electronic monitoring device 140 is a transmitter configured to transmit a signal over the network 165 to one or more electronic devices (e.g., central server 170, electronic device of a consumer 180, electronic device of a driver 185, or the like). Such a signal may include information indicating the storage temperature of the product 190 in the package 110.

In some embodiments, the electronic monitoring device 140 is programmed to generate an electronic alert for the consumer 180 in connection with the product 190, and more specifically, in connection with the temperature of the product 190 while being transported to the consumer 180 in the package 110. Some exemplary electronic alerts that may be sent to the consumer 180 from the electronic monitoring device 140 and displayed on an electronic device owned by the consumer 180 (e.g., mobile phone, tablet, laptop, or the like) may include but are not limited to text messages, electronic mail (e-mail) messages, and/or voice mail messages. In some embodiments, the consumer 180 may respond to the electronic alerts by either confirming that the consumer 180 is willing accept delivery of this product 190, or by cancelling the order for the product 190 and/or requesting a delivery of a substitute product 190.

Figure 3:
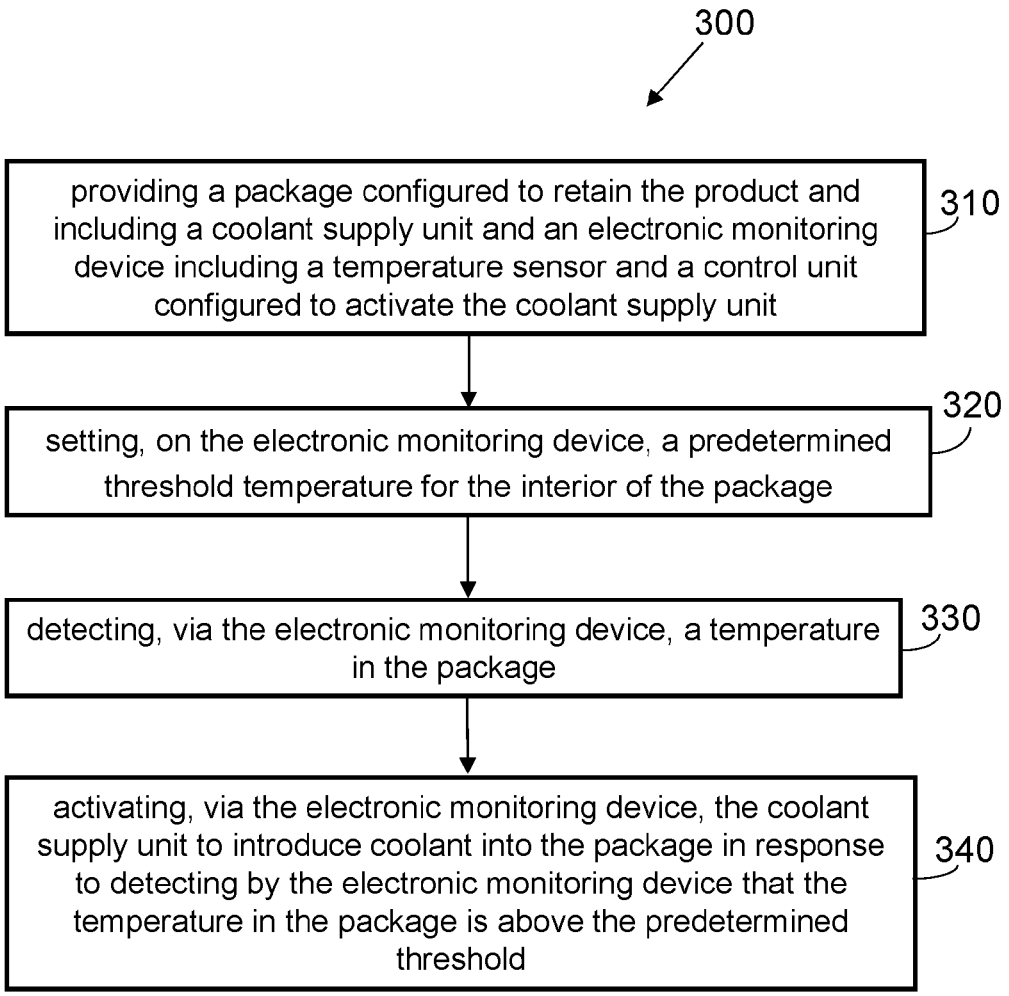
FIG. 3 is a flow chart diagram of a method of cooling a product for transportation to a consumer in accordance with some embodiments.

Referring to FIG. 3, an exemplary method 300 of cooling a product 190 is shown. Step 310 of the method 300 shown in FIG. 3 includes providing a package 110 configured to retain the product 190 and including a coolant supply unit 130 and an electronic monitoring device 140 including a temperature sensor 145 and a control unit 150 configured to activate the coolant supply unit 130. The method 300 further includes setting, on the electronic monitoring device 140, a predetermined threshold temperature for the interior of the package 110 (step 320). As discussed above, some products 190 require freezing or refrigeration and need to remain at or below a certain temperature in order for the freshness and/or texture of the products 190 to be preserved. Setting a predetermined threshold temperature for the interior cavity 120 of the package 110 where the product 190 is stored during transportation facilitates maintenance of the product 190 at or below the required threshold temperature.

The method 300 depicted in FIG. 3 further includes detecting, via the electronic monitoring device 140, a temperature in the package 110 (step 330). As described above, the detection of the temperature in the package 110 may occur as a result of the temperature sensor 145 detecting the temperature in the interior cavity 120 of the interior package 114 where the product 190 (or two or more products 190) is retained, and communicating temperature data to the control unit 150 of the electronic monitoring device 140.

The method 300 of FIG. 3 further includes activating, via the electronic monitoring device 140, the coolant supply unit 130 to introduce coolant into the package 110 in response to detecting by the electronic monitoring device 140 that the temperature in the package 110 is above the predetermined threshold (step 340). The step ensures that when the temperature of the interior cavity 120 where the product 190 is being transported in the package 110 rises above the temperature required to maintain the freshness and/or the texture of the product 190, the coolant supply unit 130 is activated such that coolant is released from the coolant container 132 and is delivered via the coolant introduction conduit 136 and the coolant disbursement nozzles 138 to the space 113 between the interior package 114 and the exterior package 112, thereby facilitating the cooling of the temperature of the product 190 in the interior cavity 120 without spraying the product 190 directly with the coolant, which would be undesirable.

Figure 4:
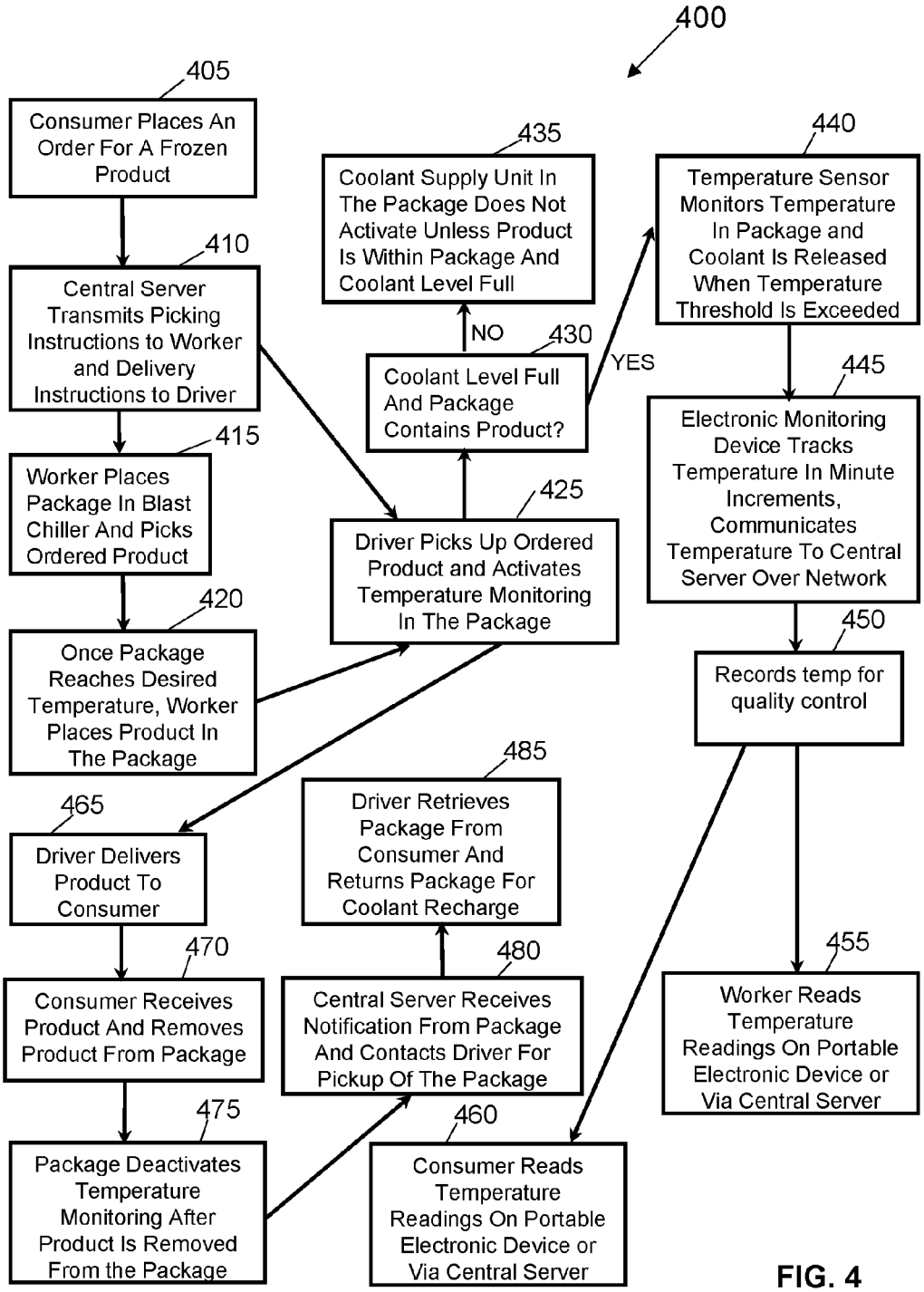
FIG. 4 is a flow chart operational diagram of a process of cooling a product for transportation to a consumer in accordance with some embodiments.

A flow chart illustrating an exemplary embodiment of a process 400 for cooling a product 190 ordered by a consumer 180 is depicted in FIG. 4. The process 400 is shown in reference to the consumer 180 ordering a frozen product such as ice cream or the like, but it will be appreciated that the process 400 may be applicable to the cooling of any temperature-sensitive product 190 ordered by a consumer 180.

As shown in FIG. 4, the process 400 may be initiated (step 405) when a consumer 180 places an order for a frozen product 190. For example, after the consumer 180 places an internet order for the product 190 via an order processing server of a given retail provider (e.g., Walmart), the order information is communicated from the order processing server to the central server 170 of the retail provider. The central server 170 then transmits an instruction to a worker 195 at a product distribution facility or an order fulfillment facility to pick the product 190 ordered by the consumer 180 from a storage bin or storage shelf, and transmits an instruction to a driver 185 that a delivery of the product 190 is scheduled (step 410). Such instructions may be transmitted by the central server 170 via the network 165 to an electronic device (e.g., tablet, mobile phone, and/or product scanner, or the like) of the worker 195 and/or the driver 185.

In the embodiment shown in FIG. 4, upon receiving the instruction from the central server 170 to pick the product 190 ordered by the consumer 180 from a storage area, the worker 195 may place the package 110 into a blast chiller (or another suitable cooling device such as a refrigerator, freezer, or the like) to lower the temperature of the package 110 to a desired temperature, followed by the picking of the product 190 ordered by the consumer 180 from a storage area such as a storage bin or a storage shelf (Step 415). It will be appreciated that in some embodiments, the package 110 may be pre-stored in the blast chiller, refrigerator, or freezer such that an active step of placing the package 110 into the blast chiller is not required.

After the package 110 reaches the desired temperature in the blast chiller, the worker 195 may then place the picked product 190 into the package 110 (Step 420). In some embodiments, the indication that the package 110 in the blast chiller reached the desired temperature is transmitted from the electronic monitoring device 140 to a hand-held electronic device of a worker 195 at the product distribution/order fulfillment facility. For example, after detecting that the most recent temperature reading detected by the temperature sensor 145 corresponds to the temperature desired for the interior cavity 120 of the package 110, the electronic monitoring device 140 may transmit a signal including an indication that the package 110 in the blast chiller reached the desired temperature to the central server 170, which in turn may transmit this information to a hand-held electronic device of the worker 195.

In the embodiment of FIG. 4, after the worker 195 places the product 190 into the package 110 (which is now at the desired temperature), the driver 185 (who received a signal to pick up the ordered product 190 from the central server 170 in Step 410) picks up the package 110 containing the product 190 (or products 190) ordered by the consumer 180, and activates temperature monitoring in the package 110 (Step 425). The temperature monitoring may be activated by the driver 185 by pressing a button on the electronic monitoring device 140, or by an activation signal sent to the electronic monitoring device 140 in the package 110 from a hand-held electronic device of the driver 185. In some embodiments, each package 110 may have its own unique activation code that is required to activate the temperature monitoring via the electronic monitoring device 140. This would prevent situations where an activation signal transmitted by a driver 185 activates more than one electronic monitoring device 140.

In some embodiments, when the driver 185 picks up the product 190 ordered by the consumer 180 and attempts to activate the temperature monitoring in the package 110, the control unit 150 of the electronic monitoring device 140 is programmed to obtain product detection data from the product detecting sensor 155 (which detects whether the product 190 is present or not present in the package 110), and to obtain coolant level data from the coolant level sensor 133 (which detects whether the level of coolant in the coolant container 132 is empty, full, or between empty and full) (Step 430). In the embodiment of FIG. 4, if the product detection data obtained by the control unit 150 from the product detecting sensor 155 indicates that the product 190 is not present in the interior cavity 120 of the package 110, or if the coolant level data obtained by the control unit 150 from the coolant level sensor 133 indicates that the coolant level in the coolant container 132 is less than full, then the control unit 150 of the electronic monitoring device 140 is programmed to block activation of the temperature monitoring in the package 110 by the temperature sensor 145 (Step 435). Conversely, if the product detection data obtained by the control unit 150 from the product detecting sensor 155 indicates that the product 190 is present in the package 110, and if the coolant level data obtained by the control unit 150 from the coolant level sensor 133 indicates that the coolant level in the coolant container 132 is full, then the control unit 150 of the electronic monitoring device 140 is programmed to permit activation of the temperature monitoring in the package 110 by the temperature sensor 145.

After the electronic monitoring device 140 activates the temperature monitoring in the package 110, the temperature sensor 145 monitors the temperature of the product 190 in the interior cavity 120 of the package 110 and ensures that the product 190 is maintained at or below the threshold temperature predetermined (i.e., entered into the electronic monitoring device 140) for the product 190 to preserve the freshness and/or the texture of the product 190. To that end, the control unit 150 of the electronic monitoring device 140 is programmed to activate the coolant supply unit 130 if the temperature in the interior cavity 120 of the package 110 rises above the predetermined threshold to release coolant from the coolant container 132 and via the coolant introduction conduit 136 and coolant disbursement nozzles 138 into the space 113 between the interior package 114 and the exterior package 112, thereby lowering the temperature of the product 190 to the predetermined threshold temperature (Step 440). In the embodiment of FIG. 4, the electronic monitoring device 140 obtains temperature data from the temperature sensor 145 at preset time intervals (e.g., 1 minute, 2 minutes, 3 minutes, 4 minutes, 5 minutes, or more) to track the temperature of the product 190 inside of the package 110 in real-time (Step 445). Such temperature monitoring and the release of coolant by the coolant supply unit 130 when the predetermined temperature threshold for the product 190 is exceeded advantageously maintains the product 190 in the package 110 at or below the desired temperature during transportation of the product 190 to the consumer 180 by the driver 185.

In some embodiments, the control unit 150 of the electronic monitoring device 140 is also programmed to transmit the temperature data obtained from the temperature sensor 145 to the central server 170 over the network 165 (step 445). In the embodiment shown in FIG. 4, the central server 170, upon receiving the temperature data from the electronic monitoring device 140, records the received temperature data in the electronic database 175 (Step 450). The temperature data stored in the electronic database 175 may be retrieved in response to a query (sent directly to the electronic database 175 or via the central server 170) from a hand-held device of a worker 195 at a product distribution or order fulfillment facility to enable the worker 195 to read the temperature readings detected by the temperature sensor 145 to determine whether the product 190 is maintained at or below the predetermined threshold temperature during delivery to the consumer 180 (Step 455). The temperature data stored in the electronic database 175 may also be retrieved in response to a query (sent directly to the electronic database 175 or via the central server 170) from a hand-held device of a consumer 180 to enable the consumer 180 to read the temperature readings detected by the temperature sensor 145 to determine whether the product 190 is maintained at or below the predetermined threshold temperature during delivery to the consumer 180 (Step 460).

After the driver 185 picks up the consumer-ordered product 190 in the package 110 (Step 425 above) and transports the product 190 in the package 110 while the temperature of the product 190 in the package 110 is being monitored and adjusted, if necessary, as described above, the driver 185 delivers the package 110 containing the product 190 to the consumer 180 (Step 465). In the embodiment shown in FIG. 4, after the package 110 containing the product 190 is delivered to the consumer 180, the consumer 180 receives the product 190 and removes the product 190 from the package 110 (Step 470). The consumer 180 may remove the product 190 from the package 110 after the driver 185 that delivered the package 110 already left, but it will be appreciated that in some embodiments, the consumer 180 may receive the package 110 from the delivery driver 185, open the package 110 to remove the product 190 while the delivery driver 185 is still present, and return the empty package 110 to the delivery driver 185 to enable the delivery driver 185 to return the empty package 110 to a product distribution or order fulfillment facility.

In the embodiment depicted in FIG. 4, the electronic monitoring device 140 automatically deactivates in response to the removal of the product 190 from the package 110 by the consumer 180 (Step 475). In some embodiments, the removal of the product 190 from the package 110 is detected by the product detecting sensor 155, which sends a signal indicating the removal of the product 190 from the package 110 to the electronic monitoring device 140, which in turn deactivates the temperature sensor 145 and the coolant supply unit 130, since no further temperature monitoring or coolant release in the package 110 is warranted after the removal of the product 190 from the package 110.

In some embodiments, the electronic monitoring device 140 transmits a signal indicating the removal of the product 190 from the package 110 and the deactivation of the temperature sensor 145 and/or the coolant supply unit 130 in the package 110 to the central server 170. In addition, in embodiments, where the package 110 remains in the possession of the consumer 180 after the driver 185 delivers the package 110 and leaves without the empty package 110, the central server 170 transmits a signal to the driver 185 (e.g., to a hand-held electronic device of the driver 185 or to a central base in communication with the driver 185), instructing the driver 185 to pick up the empty package 110 from the consumer 180 (Step 480). The driver 185 then returns to the residence or business of the consumer 180 to retrieve the package 110 from the consumer 180, and returns to the product distribution or order fulfillment facility with the empty package 110 to recharge the coolant supply unit 130 of the package 110 with coolant (485). After the coolant supply unit 130 of the package 110 is recharged with coolant, the package 110 is ready to be reused for another delivery of one or more products 190 to other consumers 180.

The systems and methods described herein provide for easy and efficient maintaining of desired temperatures for temperature-sensitive products during transportation between facilities of a retailer provider and/or during delivery to consumers. The systems, methods, and devices described herein provide for temperature-controlled delivery of one or more products to a consumer via any delivery vehicle (e.g., delivery truck, regular car, and/or unmanned aerial vehicle) not having a built-in or portable refrigeration/freezer system. As such, the systems, methods, and devices described herein advantageously save significant product transportation costs to transportation companies and/or retail providers.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A package for cooling a product, the package comprising:

an exterior package wall;

an interior package wall coupled to the exterior package wall and defining an interior cavity for retaining the product and an opening for receiving the product into the interior cavity;

a coolant supply unit configured to be activated to introduce coolant into a space between the interior package wall and the exterior package wall; and an electronic monitoring device including a temperature sensor and a control unit configured to activate the coolant supply unit to introduce the coolant into the space between the interior package wall and the exterior package wall in response to a detection by the electronic monitoring device that a temperature in the interior cavity is above a predetermined threshold;

wherein the electronic monitoring device is configured to receive, from a product detection sensor, data indicating a presence of the product in the interior cavity of the interior package wall, and wherein the control unit is configured to activate the temperature sensor only in response to receipt by the control unit of the data indicating the presence of the product in the interior cavity of the interior package wall, and wherein the control unit is configured to deactivate the temperature sensor in response to receipt by the control unit of the data indicating that the product is not present in the interior cavity of the interior package wall.

2. The package of claim 1, further comprising a closure configured to seal at least the opening of the interior package wall.

3. The package of claim 1, wherein the exterior package wall comprises an insulating material and wherein the interior package wall comprises one of a plastic, paper, and metal.

4. The package of claim 1, wherein the electronic monitoring device is further configured to activate the coolant supply unit to introduce the coolant into the space between the interior package wall and the exterior package wall in response to a detection by the temperature sensor of the electronic monitoring device that a temperature in the space between the interior package wall and the exterior package wall is above the predetermined threshold.

5. The package of claim 1, wherein the coolant supply unit includes at least one coolant introduction conduit having at least one nozzle configured to spray the coolant into the space between the interior package wall and the exterior package wall.

6. The package of claim 5, wherein the at least one coolant introduction conduit and the at least one nozzle are located in the space between the interior package wall and the exterior package wall.

7. The package of claim 1, wherein the electronic monitoring device is configured to deactivate the coolant supply unit when the temperature in the interior cavity of the interior package wall is detected by the electronic monitoring device to be at or below the predetermined threshold after introduction of the coolant into the space between the interior package wall and the exterior package wall by the coolant supply unit.

8. The package of claim 1, wherein the electronic monitoring device includes a transmitter configured to transmit temperature data representing at least one temperature value detected by the temperature sensor of the electronic monitoring device in the interior cavity of the interior package wall over a wireless connection to an electronic computing device in communication with the electronic monitoring device and configured to record the temperature data.

9. A package for cooling a product, the package comprising:

an exterior package wall;

an interior package wall coupled to the exterior package wall and defining an interior cavity for retaining the product and an opening for receiving the product into the interior cavity;

a coolant supply unit configured to be activated to introduce coolant into a space between the interior package wall and the exterior package wall; and an electronic monitoring device including a temperature sensor and a control unit configured to activate the coolant supply unit to introduce the coolant into the space between the interior package wall and the exterior package wall in response to a detection by the electronic monitoring device that a temperature in the interior cavity is above a predetermined threshold;

wherein the electronic monitoring device is configured to receive, from a coolant level sensor, data indicating a level of coolant in the coolant supply unit and wherein the control unit is configured to activate the temperature sensor only in response to receipt by the control unit of coolant level sensor data indicating that the coolant supply unit is full of coolant.

10. A method of cooling a product, the method comprising:

providing a package configured to retain the product and including a coolant supply unit and an electronic monitoring device including a temperature sensor and a control unit configured to activate the coolant supply unit;

setting, on the electronic monitoring device, a predetermined threshold temperature for the interior of the package;

detecting, via the electronic monitoring device, a temperature in the package; and activating, via the electronic monitoring device, the coolant supply unit to introduce coolant into the package in response to detecting by the electronic monitoring device that the temperature in the package is above the predetermined threshold;

further comprising receiving, from a product detection sensor, data indicating a presence of the product in an interior cavity of a package wall, and activating the temperature sensor only in response to the receiving by the control unit of the data indicating the presence of the product in the interior cavity of the package wall, and deactivating the temperature sensor in response to the receiving by the control unit of the data indicating that the product is not present in the interior cavity of the package wall.

11. The method of claim 10, further comprising providing a closure configured to seal the package.

12. The method of claim 10, wherein the package wall including an exterior layer comprising insulating material and an interior layer comprising one of a plastic, paper, and metal.

13. The method of claim 12, further comprising introducing the coolant into a space between the exterior layer and the interior layer in response to detecting by the temperature sensor of the electronic monitoring device that the temperature in the package is above the predetermined threshold.

14. The method of claim 12, wherein the coolant supply unit includes at least one coolant introduction conduit having at least one nozzle, and further comprising spraying the coolant from the at least one nozzle into a space between the exterior layer and the interior layer in response to detecting by the temperature sensor of the electronic monitoring device that the temperature in the package is above the predetermined threshold.

15. The method of claim 14, further comprising providing the at least one coolant introduction conduit and the at least one nozzle in the space between the exterior layer and the interior layer.

16. The method of claim 10, further comprising deactivating the coolant supply unit when the temperature in the package is detected by the temperature sensor of the electronic monitoring device to be at or below the predetermined threshold after introduction of the coolant into the package.

17. The method of claim 10, further comprising transmitting, from the electronic monitoring device, temperature data representing at least one temperature value detected by the electronic monitoring device in the package wall, over a wireless connection to an electronic computing device in communication with the electronic monitoring device and configured to record the temperature data.

18. A method of cooling a product, the method comprising:

providing a package configured to retain the product and including a coolant supply unit and an electronic monitoring device including a temperature sensor and a control unit configured to activate the coolant supply unit;

setting, on the electronic monitoring device, a predetermined threshold temperature for the interior of the package;

detecting, via the electronic monitoring device, a temperature in the package; and activating, via the electronic monitoring device, the coolant supply unit to introduce coolant into the package in response to detecting by the electronic monitoring device that the temperature in the package is above the predetermined threshold;

further comprising receiving, from a coolant level sensor, data indicating a level of coolant in the coolant supply unit and activating the temperature sensor only in response to the receiving by the control unit of coolant level sensor data indicating that the coolant supply unit is full of coolant.

* * * * *